US007758365B2

(12) United States Patent
Purchon

(10) Patent No.: US 7,758,365 B2
(45) Date of Patent: Jul. 20, 2010

(54) SELF-MUTING AUDIO CONNECTOR

(75) Inventor: Jeffrey Howard Purchon, Acton, MA (US)

(73) Assignee: Gig-fx, Inc., Waltham, MA (US)

( * ) Notice: Subject to any disclaimer, the term of this patent is extended or adjusted under 35 U.S.C. 154(b) by 0 days.

(21) Appl. No.: 12/214,002

(22) Filed: Jun. 16, 2008

(65) Prior Publication Data

US 2009/0011628 A1 Jan. 8, 2009

Related U.S. Application Data

(63) Continuation-in-part of application No. PCT/US2006/001782, filed on Jan. 17, 2006.

(51) Int. Cl.
*H01R 29/00* (2006.01)

(52) U.S. Cl. ..... 439/188

(58) Field of Classification Search ..... 439/188, 439/668, 669; 200/51.1

See application file for complete search history.

(56) References Cited

U.S. PATENT DOCUMENTS

| | | | | |
|---|---|---|---|---|
| 4,275,946 A | | 6/1981 | Manina et al. | 339/183 |
| 4,275,947 A | * | 6/1981 | Takagi | 439/188 |
| 5,076,797 A | | 12/1991 | Moulon | 439/188 |
| 5,238,422 A | * | 8/1993 | Scherer | 439/188 |
| 5,466,167 A | | 11/1995 | Scherer | 439/188 |
| 5,818,000 A | | 10/1998 | Ma et al. | 200/51.03 |
| 6,143,995 A | | 11/2000 | Ward | 200/51.05 |

OTHER PUBLICATIONS

International Application PCT/US06/01782 (Applicant's parent application)—PCT International Search Report and Written Opinion, Aug. 25, 2006, 6 pages.
Deltron General Specification for 329-0102 "'Silent' ¼" Jack—2 Pole (Black), Oct. 2, 2003, 1 page.
Ki-Sound ¼ plug miscellaneous product information (3 photographs), date unknown, 2 pages.
ZZYZX Snap Jack miscellaneous product information and business card, date unknown, 1 page.
Neutrik ¼ Silent Plug miscellaneous product information, miscellaneous dates at least as early as Jan. 21, 2006, 6 pages.
Planet Waves "Circuit Breaker" Cable miscellaneous product information, miscellaneous dates at least as early as Jan. 24, 2003, 3 pages.
Switchcraft Silent-Plug Phone Plugs (technical illustration showing longitudinally moving Circuit Closing Device), date unknown (admitted prior art), 1 page.

* cited by examiner

*Primary Examiner*—Phuong K Dinh

(57) ABSTRACT

This disclosure concerns methods, systems and apparatus that can be automatically activated by means of insertion into a jack socket and designed such that when inserted, no longitudinal force is exerted on the jack. In particular, self-muting connectors employ a spring-biased switch with an internal spring and a protrusion. When the connector is disconnected, the protrusion extends outwardly of a ground sleeve and the spring contacts an inner signal conductor. In this state, the switch shorts the signal conductor and ground sleeve together. When the connector is inserted into a complementary jack socket, the protrusion is urged inwardly and the spring deformed such that it ceases to contact the inner conductor, thereby the breaking the short-circuit between the signal conductor and ground sleeve. This allows a normal electrical connection to be established between the connector and the device to which the connector is inserted.

17 Claims, 8 Drawing Sheets

SELF-MUTING AUDIO CONNECTOR

CROSS REFERENCE TO RELATED CASES

This is a continuation-in-part application of co-pending PCT International Application PCT/US2006/01782 with an international filing date of Jan. 17, 2006 and entitled "Self-Muting Audio Connector" which application is hereby incorporated by reference.

BACKGROUND OF THE INVENTION

1. Field of the Invention

The present invention relates to audio signal phone connectors, and in particular to such a connector providing a means for establishing an automatic grounded termination for the connector upon removal of the connector from an external jack. Accordingly, the general objects of the invention are to provide novel systems, methods, and apparatus of such character.

2. Description of the Related Art

The present invention is an improvement in an electrical connecting device commonly known as a "phone plug" which terminates an electrical cable and permits the cable to be readily connected and disconnected to electrical apparatus. In addition to its many other applications, the phone plug has become the standard device by which electrically amplified musical instruments are connected to their amplifiers. One of the characteristics of the phone plug that has elevated it to a standard piece of equipment for an electrical cable, is the elegant simplicity of its design. The phone plug, which has no moving parts, is sturdy and sure in performing its function permitting it to be connected and disconnected countless times without failure. The mechanical and electrical features of conventional phone connectors and jacks are well known in the art and have become standard, universally used components in the field of audio electronics.

What is also universal, however, is the highly undesirable noise that occurs when a phone plug is connected or disconnected from an instrument while the instrument's amplifier is on. Under those circumstances, it is virtually impossible to either insert or withdraw the phone plug from its jack without the tip from contacting some signal generating element, whether it be part of the jack, the person handling the equipment, or some other nearby object. When the tip makes such contact, the result is an annoying and potentially dangerous sound emanating from the speakers being driven by the amplifier to which the cable is connected. This is an annoying and unwanted noise and can be quite loud, especially for a performing musician in front of an audience.

To avoid this problem in the past, musicians had to either unplug the end of the cable that is inserted into the amplifier, or turn the amplifier volume down so that the cable could be inserted into the instrument quietly. In both cases, the musician had to take an extra step to avoid the unwanted noise. In some cases, the amplifier can be a considerable distance from the front of the stage so it can be inconvenient to do this. A professional musician might need to change instruments several times during a performance thereby compounding the problem.

These deficiencies have led to the development of audio connectors having ground switches integrated into the connector itself. These products attempt to solve this problem, however, they have been unsatisfactory as either too complicated, too costly, too unreliable, or some combination thereof. One such self-muting connector has been commercialized by Deltron. The Deltron device employs a pair of coaxial ground sleeves arranged such that one externally spring-biased sleeve may slide longitudinally relative to the other to thereby permit selective grounding based on insertion and/or removal of the connector. In practice however, the Deltron design exerts a longitudinal spring force such that it may at least partially eject the phone connector from the socket. In particular, some jack sockets have weak tip springs and are therefore not capable of holding the plug in place. If so, the plug can be ejected sufficiently to so that the signal is lost intermittently or entirely. For a performing musician, this presents a significant reliability issue. It is not desirable to be part way through a song or a solo when the signal disappears.

A second commercially available design is available from a company called Planet Waves who offers a phone connector with a manually operated switch on the side of the phone connector body. This allows the musician to manually switch the signal off before unplugging the jack from the socket. The problem with this solution however is that it still presents the musician with an extra action that needs to be performed, usually under pressure. Additionally, it is difficult to see if the switch is on or off, so the musician might not get any sound from his amplifier and/or may not deduce that it is caused by the switch being engaged in the off position.

A third connector design that solves some of the above noted problems is taught by U.S. Pat. No. 5,466,167 to Scherer. The self-muting device of the '167 patent offers the benefits that it (1) offers automatic switching operation; and (2) does not apply a longitudinal force that may tend to eject the connector from a complementary jack socket. The device taught by the '167 patent, however, is still less than optimal for a number of reasons. First, the design still involves a modest level of expense and complexity to manufacture. This aspect is critical because of the high-volume and marginally profitable nature of such devices. Second, the device of the '167 patent introduces reliability concerns that tends to undermine one of the most valuable characteristics of conventional phone connectors: astounding reliability over an extended period of time and repeated usage.

For these reasons alone, these prior art devices, as well as others of the same general description, have still not enjoyed any significant commercial success after many years.

There is, accordingly, a need in the art for improved methods, systems and apparatus to eliminate the effects of spurious extraneous signals, undesired signal emissions and signal reflections on the circuitry connected to the phone connector. In particular, such methods and apparatus should provide a simple and inexpensive connector which can be automatically muted whenever it is disconnected from an external jack socket. Such methods, systems and apparatus will ideally offer users/purchasers an optimal combination of (1) simplicity; (2) reliability; (3) economy; and (4) versatility.

SUMMARY OF THE INVENTION

The present invention satisfies the above-stated needs and overcomes the above-stated and other deficiencies of the related art by providing methods, systems and apparatus that can be automatically activated by means of insertion into a jack socket and designed such that when inserted, no longitudinal spring force is exerted on the jack socket. In particular, self-muting connectors in accordance with the invention employ a spring-biased switch with an internal spring and a partially exposed protrusion. When the connector is in a disconnected state, the protrusion extends outwardly of a ground sleeve and the spring contacts an inner signal conductor. In this state, the switch shorts the signal conductor and ground sleeve together. When the connector is inserted into a complementary jack socket, the protrusion is urged inwardly and the internal spring is deformed such that it ceases to contact the inner conductor, thereby the breaking the short-circuit between the signal conductor and ground sleeve. The breaking of this connection allows a normal electrical connection to be established between the connector and the device to which the connector is inserted. The invention may be applied to both monophonic and stereo phonic audio phone connectors.

The spring switch may comprise a conductive conductor-engaging member, a ground-sleeve engaging member and a resilient (or spring biased) intermediate member. The ground-sleeve engaging member is in substantially continuous contact with the inner surface of outer sleeve and the conductor-engaging member is in selective contact with inner signal conductor. Alternatively, the spring switch may be a coil spring that is substantially "e-shaped" in cross-section.

Other important aspects of the invention include a novel internal spring switch for use in an inventive self-muting connector of the type discussed herein. One advantage of this switch is that it is not physically affixed to any other part therefore needs no assembly procedures or complicated attachments other than a simple insertion.

The invention can also take the form of a method of manufacturing the self-muting audio connector of the type discussed herein.

Naturally, the above-described methods of the invention are particularly well adapted for use with the above-described apparatus of the invention. Similarly, the apparatus of the invention are well suited to perform the inventive methods described above.

Numerous other advantages and features of the present invention will become apparent to those of ordinary skill in the art from the following detailed description of the preferred embodiments, from the claims and from the accompanying drawings.

BRIEF DESCRIPTION OF THE DRAWINGS

The preferred embodiments of the present invention will be described below with reference to the accompanying drawings where like numerals represent like steps and/or structures and wherein.

DETAILED DESCRIPTION OF THE PREFERRED EMBODIMENTS

Figure 1:
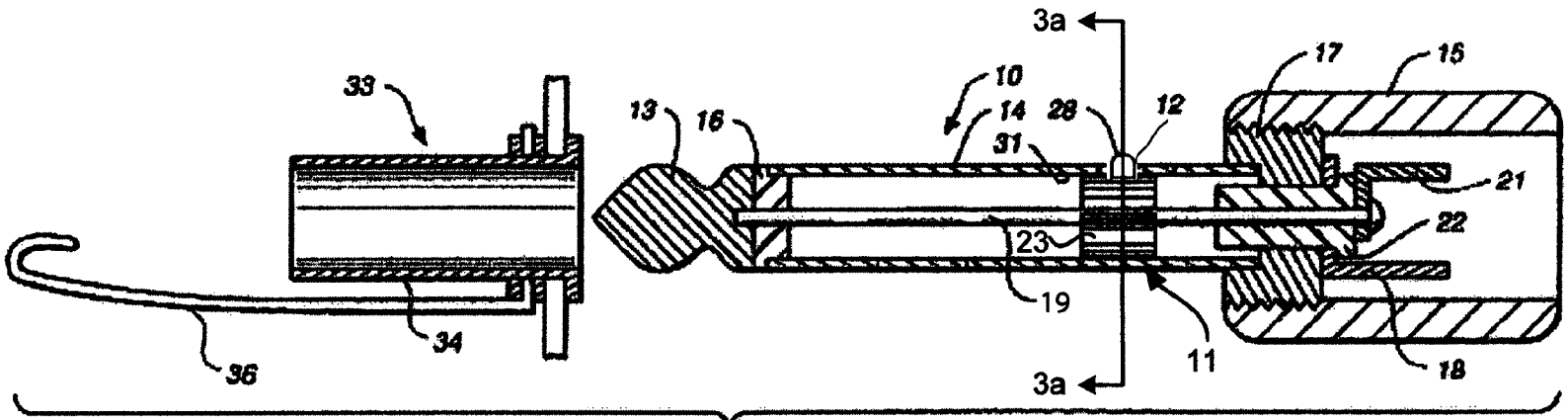
FIG. 1 is a side elevation view of a self-muting mono connector and jack in accordance with one preferred embodiment of the present invention.

With joint reference to FIGS. 1, 2, 3*a* and 3*b*, a self-muting audio connector in accordance with a first preferred embodiment is shown and its operation illustrated therein. In particular, an inventive mono phone or "TS" (tip-sleeve) connector 10 is shown with a cylindrical, tubular outer sleeve 14 which is terminated at one of its ends by a tip 13 and at its other end by an enlarged threaded flange 17 onto which is threaded a connector body 15. The tip 13 electrically is insulated from sleeve 14 by an annular insulator 16 and connected to a cylindrical inner rod 19 that is coaxial within the outer sleeve 14. The inner rod 19 extends through (without contacting) flange 17 and is secured at the rear of the flange to an electrical terminal 21 which is insulated from flange 17 by an insulator 22. A second electrical terminal 18 is affixed to flange 17 and thereby electrically connected to outer ground sleeve 14 and terminal 21 is electrically connected to tip 13 through rod 19 and insulated from outer sleeve 14, flange 17, and ground terminal 18.

In its well known use to carry audio signals, TS connector 10 is coupled to a coaxial shielded cable (not shown) by soldering the cable ground conductor to ground terminal or lug 18 and the central signal-carrying conductor of the cable to terminal 21. In this way, the tip 13 may be electrically coupled between two external circuits, such as a musical instrument and an operating amplifier, while sleeve 14 may be grounded. It is the fact that tip 13 is electrically coupled in this way that gives rise to the problems of the prior art set forth above in terms of screeching and possible damage to amplifiers and speakers. In order to avoid component damage and screeching, the present invention provides a spring-biased grounding switch 11 with a coil spring 23 disposed between the inner surface of tubular sleeve 14 and the outer surface of a signal conductor 19. As shown, signal conductor 19 is preferably a rod shaped member, but it may take many other forms as it is merely a matter of design choice. When connector 10 is not inserted into an external jack, there is no force applied to protrusion 28, see FIGS. 1 and 3*a*, and the spring bias of the coil spring 23 causes the contact between it and rod 19. Since conductive spring 23 is also urged against the interior surface of sleeve 14, tip 13 is grounded through rod 19, switch 11 and sleeve 14. In this way, whenever the phone connector is not in use (not inserted into a jack such as jack 33) the tip 13 is muted (grounded) and thus, there is no potential for generating a noise signal to be fed into the amplifier and broadcast through the speakers.

With continuing joint reference to FIGS. 1-3*b*, grounding switch 11 comprises a conductive coil spring 23 that is in substantially continuous contact with the inner surface of outer sleeve 14 and in selective contact with inner signal conductor 19. Nonetheless, switch 11 is preferably neither affixed to sleeve 14 nor affixed to rod 19. Rather, the spring-biasing force of switch coil 23 preferably urges protrusion 28 through an aperture 12 and, in the state shown in FIGS. 1 and 3*a*, urges itself against rod 19.

Figure 2:
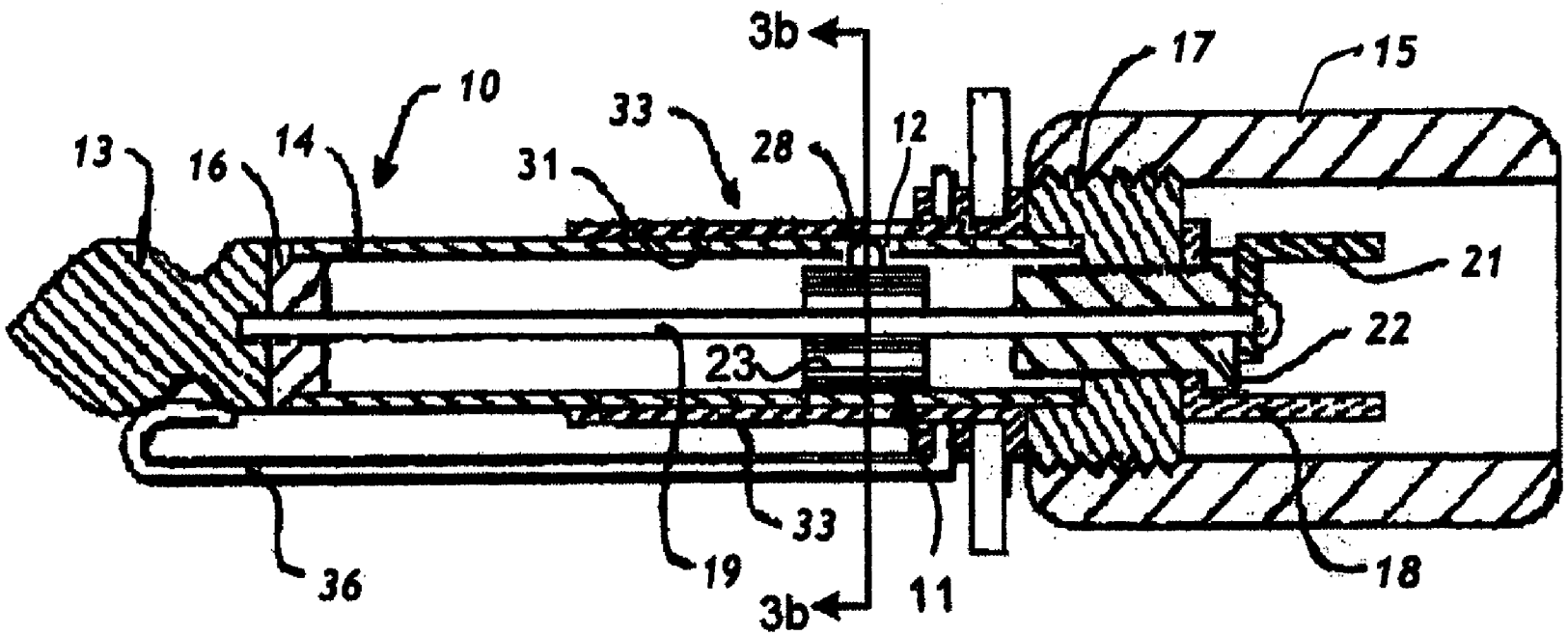
FIG. 2 is another side elevation of the self-muting connector of FIG. 1 in which the connector has been inserted into the jack.
Figure 3B:
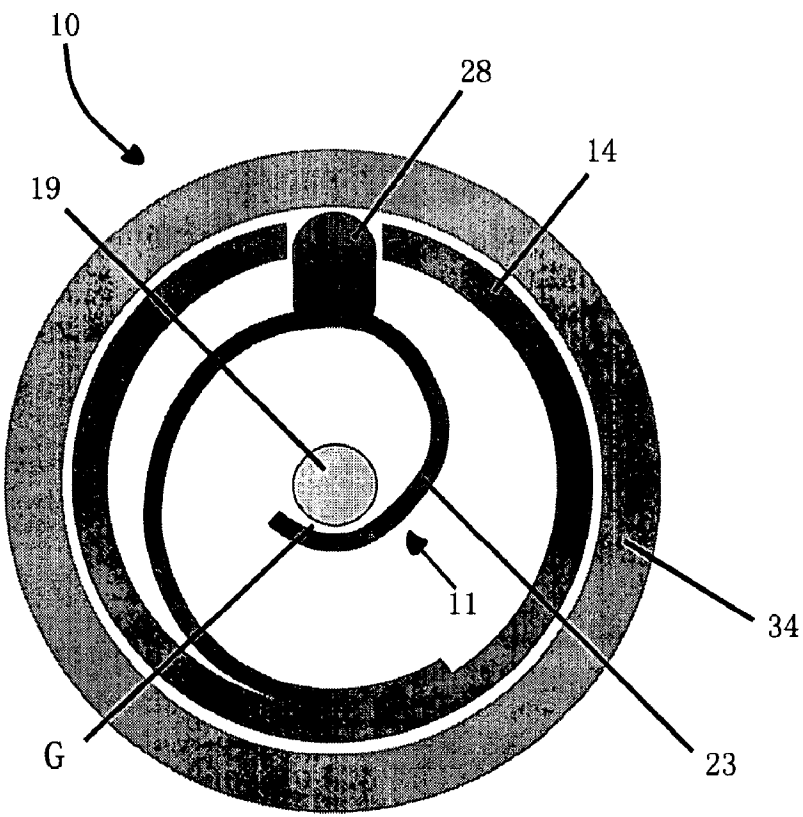
FIG. 3*b* shows a cross sectional view of the connector of FIG. 2 taken along line 3*b*-3*b.*

With emphasis now to FIGS. 2 and 3*b*, in particular, in operation the connector 10 is inserted into jack 33 which includes a cylindrical receiving wall 34 having an inner diameter just slightly larger than the outer diameter of sleeve 14 and a tip contact and securing member 36. While the force of coil 23 is sufficient to prevent longitudinal motion of switch 11 relative to sleeve 14 during normal use, it is also resilient enough to permit protrusion 28 to move radially inward when connector 10 is inserted into an external jack 33. Such radially inward motion deforms coil 23 sufficiently to thereby automatically break the contact between coil 23 and rod 19. This creates a gap G between coil 23 and rod 19. When this occurs, a signal presented to terminal 21 is no longer shorted to ground and may pass to tip 13 and vice versa. This allows a normal electrical connection to be established between the connector and the device to which the connector is inserted.

Figure 3A:
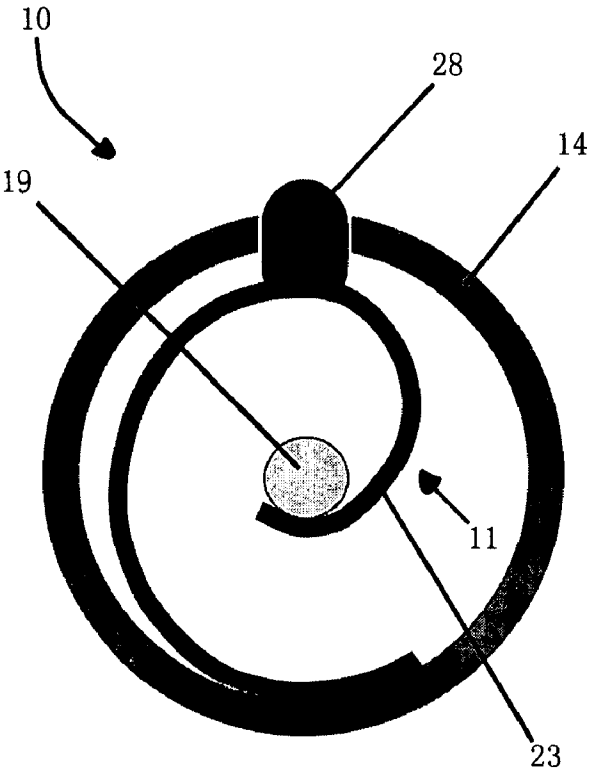
FIG. 3*a* shows a cross-sectional view of the connector of FIG. 1 taken along line 3*a*-3*a;*

Coil spring 23 is advantageously formed from a strip of conducting material, such as hardened spring steel, sized and shaped to bias itself (forming a physical and an electrical connection) against the inner wall of the cylindrical sleeve 14. As best seen in FIGS. 3*a* and 3*b*, switch 11 is preferably generally "e-shaped" in cross-section. The coil spring spans the space between sleeve 14 and rod 19, making electrical contact between the inner rod 19 and the grounded outer sleeve 14. The protrusion 28 is preferably integrally formed with coil 23 by stamping a generally hemispherical detent into the inside of coil 23. Protrusion 28 is, therefore, also preferably formed of the same piece of spring steel as coil 23. In an alternative construction, protrusion 28 may be formed from one of many well know durable materials, regardless of whether they are conductive or non-conductive, such as nylon, plastic, brass, steel or the like. With such an alternative construction, coil 23 may include an aperture through with a portion of the protrusion may extend to enhance affixation.

The location of aperture 12 in the outer sleeve 14 determines the distance between the protrusion 28 and the tip 13. By adjusting that distance a given connector can be either a make-before-break connector or a break-before-make connector. When the distance between the tip 13 and the protrusion 28 is such that the protrusion is depressed by the jack wall 34 before the tip 13 contacts the securing member 36, the switch 11 will "break" before the tip "makes" connection with the securing member. When on the other hand, the distance between the tip 13 and the protrusion 28 is such that the protrusion is depressed by the jack wall 34 after the tip 13 contacts the securing member 36, the tip 13 "makes" contact with the jack tip connector 36 before the switch 11 "breaks" (while the tip is still grounded). Whether a connector is designed to be a make-before-break or a break-before-make depends on the application and the electrical devices involved. The present invention is capable of providing either with only a slight change in the location of the protrusion aperture 12. No other modification is required.

One particularly advantageous feature of the invention is that switch 11 is preferably not affixed either rod 19 or sleeve 14 by any conventional means such as a fastener or bonding material. This represents a significant advantage over the related art devices in that assembly of connector 10 is greatly simplified, less expensive and involves fewer components. In particular, switch 11 is preferably inserted into sleeve 14 such that protrusion 28 is aligned with aperture 12, and then longitudinally slid into sleeve 14 until protrusion 28 engages with aperture 12. In this way, the coil spring is self-aligning and does not require any precise location or matching parts during the manufacturing process.

Figure 4:
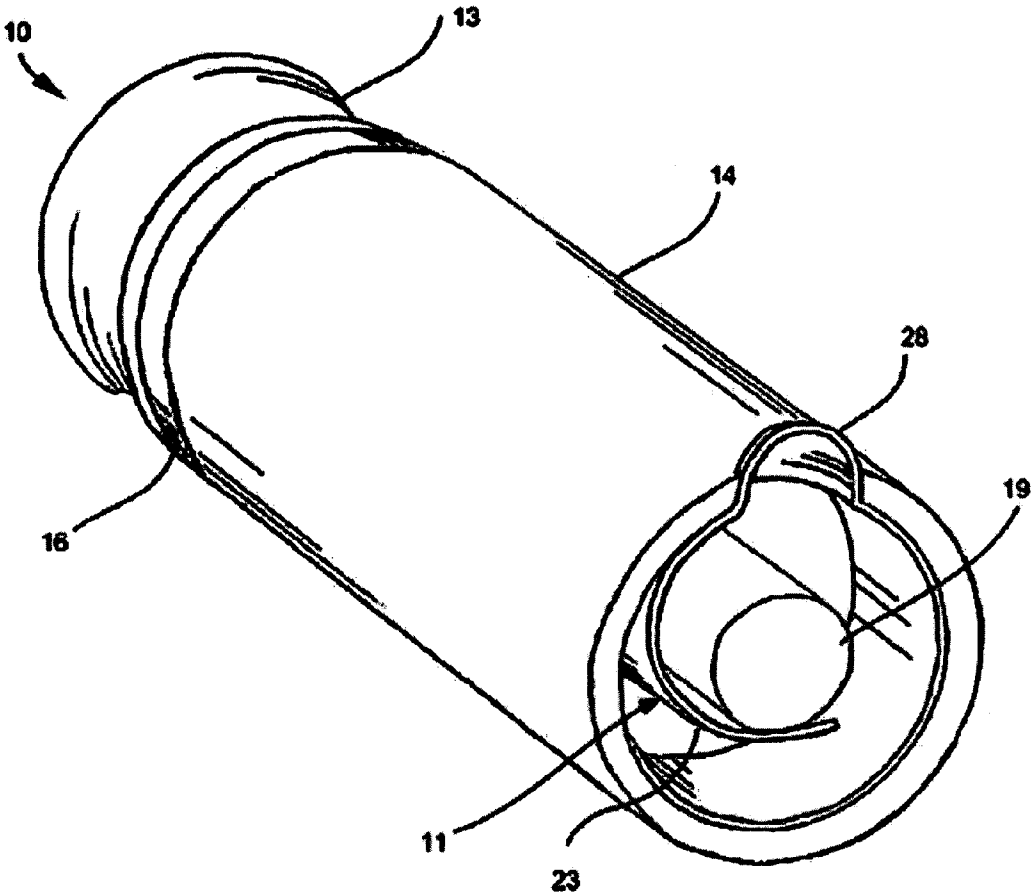
FIG. 4 depicts a perspective cross-sectional view of the connector of FIG. 1 taken along line 3*a*-3*a;*
Figure 5:
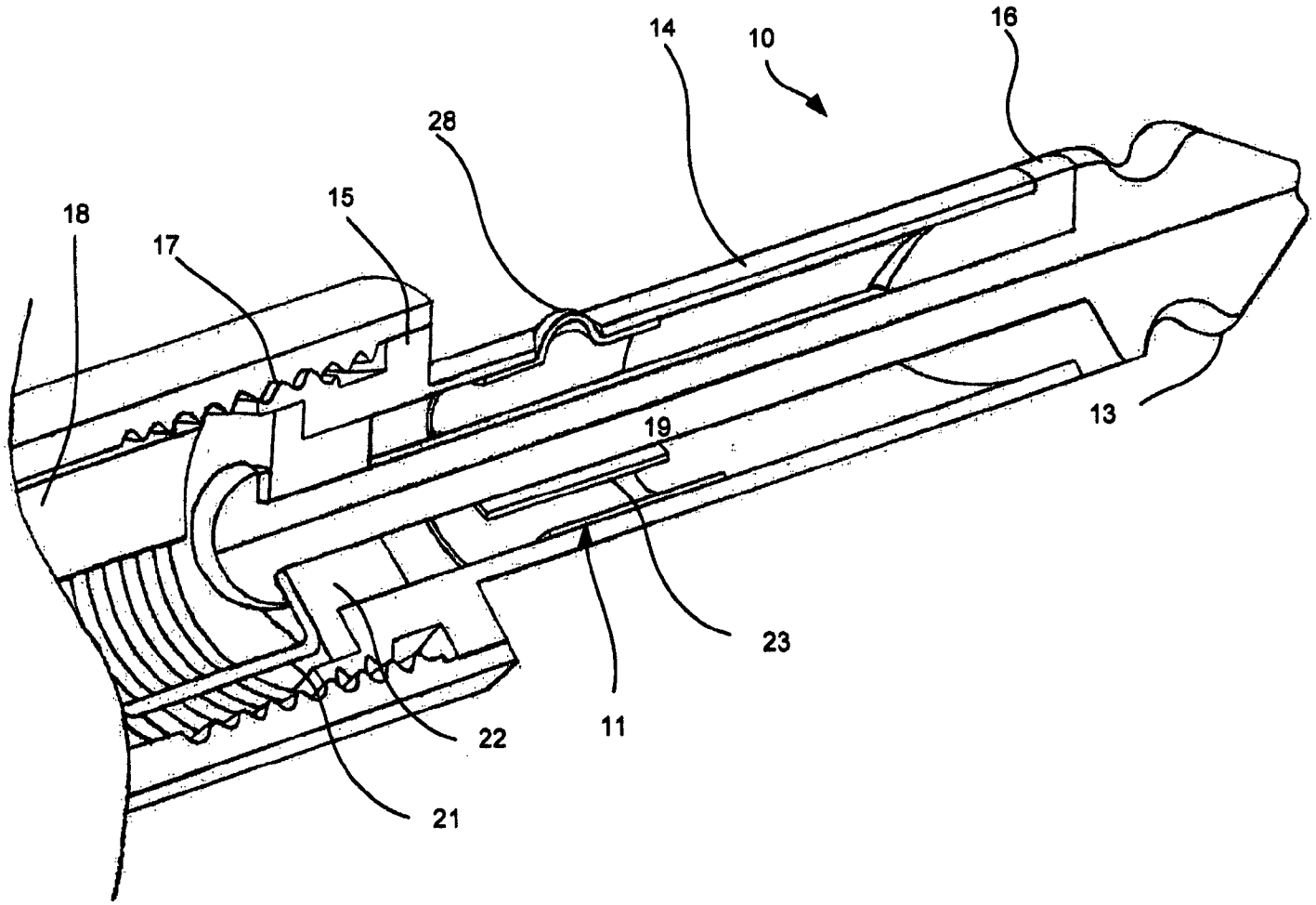
FIG. 5 is a partial cut-away perspective view of the connector of FIG. 1.

With emphasis shifted to the cut-away, perspective views of FIGS. 4 and 5, one may still better appreciate the construction of the embodiment first shown in FIG. 1. In particular, one of ordinary skill will still better observe that switch 11 is preferably integrally formed and that protrusion 28 is preferably stamped from the coil to thereby form a hollow hemispherical member. It will, however, be appreciated that protrusion 28 may be formed into other shapes (for example, an elongated bar, or a cone) as long as aperture 12 is also changed to complement/accommodate such other shapes. As shown in these Figures, it has been found that coil 23 should be between about 0.4 cm (0.1587 inches) and about 1.0 cm (0.3968 inches) long provide the desired biasing force and physical stability (0.7 cm—0.2778 inches—being most preferred).

Figure 6B:
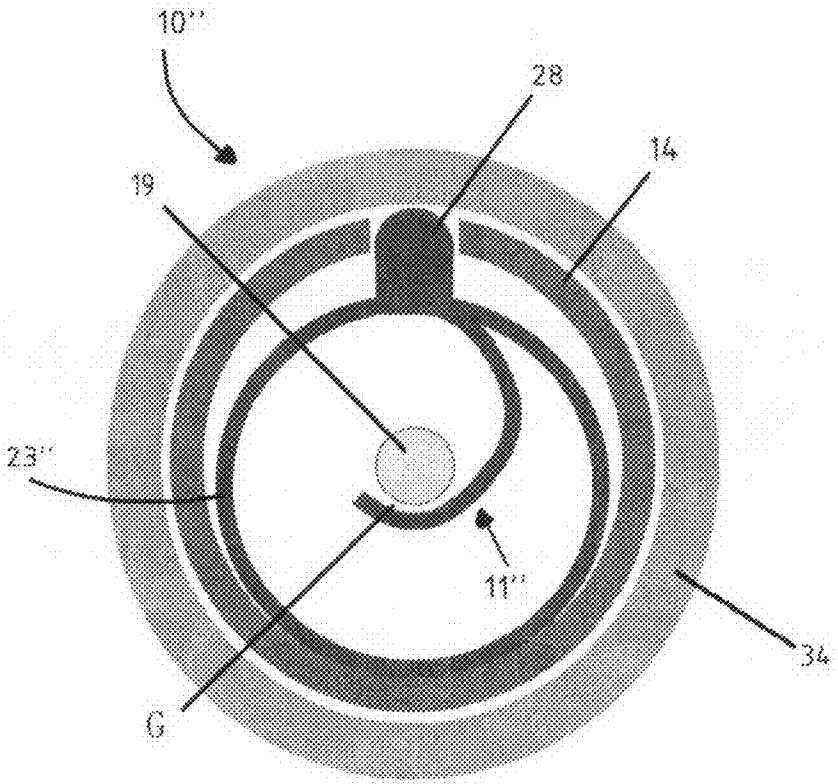
FIGS. 6*a* and 6*b* are cross-sectional views of a self-muting mono connector in accordance with still another preferred embodiment of the present invention.
Figure 6A:
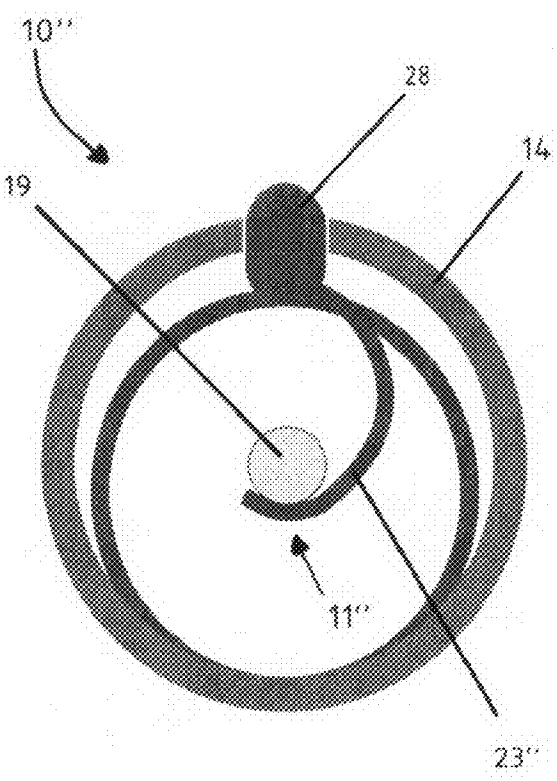

Another alternative embodiment of the inventive switch in accordance with the present invention is shown in cross-section and in operation in FIGS. 6*a* and 6*b*. As shown, mono self-muting connector 10" is substantially similar to mono self-muting connector 10 of FIGS. 1 through 5. The primary difference between the two resides in the design of coil-spring switch 11". In particular, coil spring 23" preferably forms a closed loop with a portion thereof extending inwardly to permit selective contact with inner rod 19 as discussed above. Spring 23" may be formed from a tubular piece of conductive material such as metal into which a portion has been stamped to form the inwardly extending portion. Additionally, protrusion 28 may be formed in any manner discussed above with respect to the spring 23". Alternatively, spring 23" may be formed as a closed loop in the sense that a portion of the coil overlaps but is not affixed together in the overlapping portion thereof.

With joint reference to FIGS. 7*a* through 8*b*, a self-muting audio connector in accordance with another preferred embodiment is shown and its operation illustrated therein. In particular, an inventive mono phone or "TS" (tip-sleeve) connector 10'" is shown with a cylindrical, tubular outer sleeve 14' which is terminated at one of its ends by a tip 13' and at its other end by an enlarged threaded flange 17' onto which is threaded a connector body 15'. The tip 13' electrically is insulated from sleeve 14' by an annular insulator 16' and connected to a cylindrical inner rod 19" that is coaxial within the outer sleeve 14'. The inner rod 19" extends through (without contacting) flange 17' and is secured at the rear of the flange to an electrical terminal 21' which is insulated from flange 17' by an insulator 22'. A second electrical terminal 18' is affixed to flange 17' and thereby electrically connected to outer ground sleeve 14'. Terminal 21' is electrically connected to tip 13' through rod 19" and insulated from outer sleeve 14', flange 17', and ground terminal 18'.

In its use to carry audio signals, TS connector 10'" is coupled to a coaxial shielded cable (not shown) by soldering the cable ground conductor to ground terminal or lug 18' and the central signal-carrying conductor of the cable to terminal 21'. In this way, the tip 13' may be electrically coupled between two external circuits, such as a musical instrument and an operating amplifier, while sleeve 14' may be grounded. It is the fact that tip 13' is electrically coupled in this way that gives rise to the problems of the prior art set forth above in terms of screeching and possible damage to amplifiers and speakers. In order to avoid component damage and screeching, this embodiment of the present invention provides a spring-biased grounding switch 11'" disposed between the inner surface of tubular sleeve 14' and the outer surface of a signal conductor 19". As shown, signal conductor 19" is preferably a rod shaped member, but it may take many other forms as it is merely a matter of design choice. When connector 10'" is not inserted into an external jack, there is no force applied to protrusion 28' and the spring bias of the spring switch 11'"

causes the contact between grounding sleeve 14' and rod 19". Since conductive spring 11'" is urged against the interior surface of sleeve 14', tip 13' is grounded through rod 19", switch 11'" and sleeve 14'. In this way, whenever the phone connector is not in use (not inserted into a jack, such as jack 33 of FIG. 1) the tip 13' is muted (grounded) and thus, there is no potential for generating a noise signal to be fed into the amplifier and broadcast through the speakers.

With continuing joint reference to FIG. 7*a* through 8*b*, grounding switch 11'" comprises a conductive conductor-engaging member 24, a ground-sleeve engaging member 26 and a resilient (or spring biased) intermediate member 25. The ground-sleeve engaging member 26 is in substantially continuous contact with the inner surface of outer sleeve 14' and the conductor-engaging member 24 is in selective contact with inner signal conductor 19". Nonetheless, switch 11'" is preferably neither affixed to sleeve 14' nor affixed to rod 19". Rather, the spring-biasing force of member 25 preferably urges protrusion 28' through an aperture 12' and, in the state shown in FIGS. 8*a* and 8*b*, urges itself against rod 19". Member 26 is preferably resilient and sized and shaped to snugly fit within the inside of sleeve 14' and it may, optionally, include a number of slight outward protrusions P to aid with such engagement and to thereby provide additional stability. Also, member 24 preferably includes one or more contacts C that enable more precise and reliable selective electrical coupling with signal conductor 19".

In operation the connector 10'" is inserted into a jack which includes a cylindrical receiving wall having an inner diameter just slightly larger than the outer diameter of sleeve 14' and a tip contact and securing member (such as member 36 of FIG. 1). While the force of member 25 is sufficient to prevent longitudinal motion of switch 11'" relative to sleeve 14' during normal use, it is also resilient enough to permit protrusion 28' to move radially inward when connector 10'" is inserted into an external jack. Such radially inward motion deforms member 25 sufficiently to thereby automatically break the electrical contact between member 24 and rod 19". This creates a gap (not shown) between spring conductor-engaging member 24 and rod 19". When this occurs, a signal presented to terminal 21' is no longer shorted to ground and may pass to tip 13' and vice versa. This allows a normal electrical connection to be established between the connector and the device to which the connector is inserted.

Figure 8A:
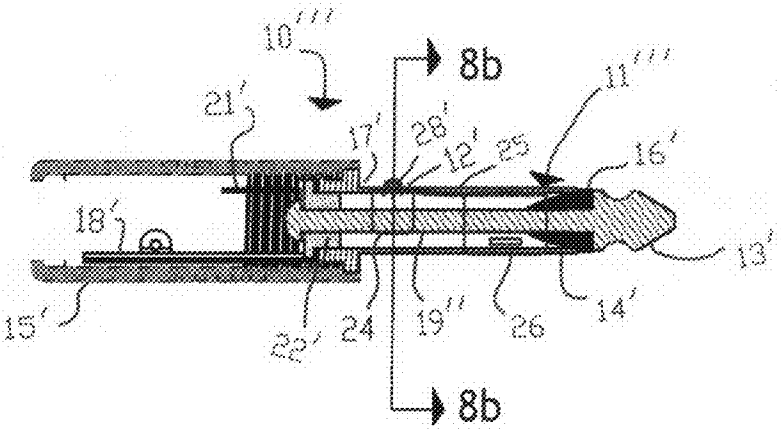
FIG. 8*a* is a side-elevation view of a self-muting connector in accordance with another preferred embodiment of the present invention, the connector using the spring switch of FIGS. 7*a* through 7*e;*
Figure 8B:
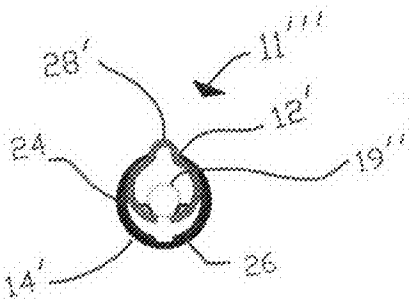
FIG. 8*b* shows a cross-sectional view of the connector of FIG. 8*a* taken along line 8*b*-8*b.*
Figure 7C:
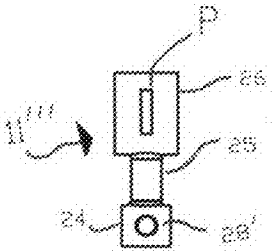
FIGS. 7*a* through 7*e* are axial, bottom, top, right and left views of a spring switch for a self-muting connector in accordance with still another preferred embodiment of the present invention.
Figure 7A:
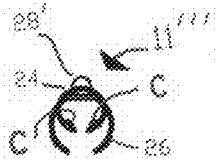
Figure 7B:
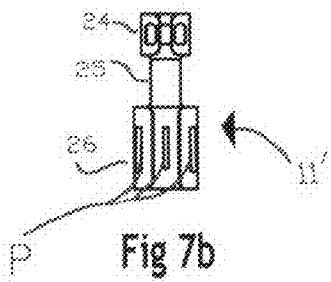
Figure 7E:
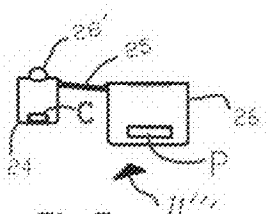
Figure 7D:
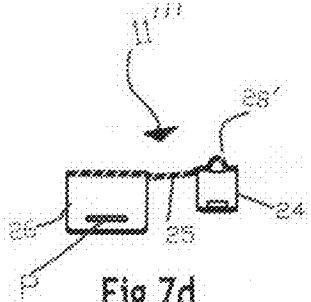

Spring switch 11'" is advantageously formed from a strip of conducting material, such as hardened spring steel, (or Beryllium Copper) sized and shaped to bias itself (forming a physical and an electrical connection) against the inner wall of the cylindrical sleeve 14'. As best seen in FIGS. 7*a* and 8*b*, members 24 and 26 are preferably elongated, generally "c-shaped" in cross-section and are respectively aligned along parallel axes. By contrast, member 25 is preferably a slightly curved strip that is angled relative to the parallel axes. Member 24 may also be described as being generally "horseshoe-shaped," by which is meant the member as shown in FIGS. 7*a* through 8*b* and also referred to above as generally "c-shaped." The spring 11'" spans the space between sleeve 14' and rod 19", making electrical contact between the inner rod 19" and the grounded outer sleeve 14'. The protrusion 28' is preferably integrally formed with the spring by stamping a generally hemispherical detent into the inside of spring 11'". Protrusion 28' is, therefore, also preferably formed of the same piece of spring as the rest of switch 11'". In an alternative construction, protrusion 28' may be formed from one of many well know durable materials, regardless of whether they are conductive or non-conductive, such as nylon, plastic, brass, steel or the like. With such an alternative construction, member 24 may include an aperture through which a portion of the protrusion may extend to enhance affixation.

The location of aperture 12' in the outer sleeve 14' determines the distance between the protrusion 28' and the tip 13'. By adjusting that distance a given connector can be either a make-before-break connector or a break-before-make connector. When the distance between the tip 13' and the protrusion 28' is such that the protrusion is depressed by the jack wall before the tip 13' contacts the securing member, the switch 11'" will "break" before the tip "makes" connection with the securing member. When, on the other hand, the distance between the tip 13' and the protrusion 28' is such that the protrusion is depressed by the jack wall after the tip 13' contacts the securing member, the tip 13' "makes" contact with the jack tip connector before the switch 11'" "breaks" (while the tip is still grounded). Whether a connector is designed to be a make-before-break or a break-before-make depends on the application and the electrical devices involved. The present invention is capable of providing either with only a slight change in the location of the protrusion aperture 12'. No other modification is required.

One particularly advantageous feature of the invention is that switch 11'" is preferably not affixed either rod 19" or sleeve 14' by any conventional means such as a fastener or bonding material. This represents a significant advantage over the related art devices in that assembly of connector 10'" is greatly simplified, less expensive and involves fewer components. In particular, switch 11'" is preferably inserted into sleeve 14' such that protrusion 28' is aligned with aperture 12', and then longitudinally slid into sleeve 14' until protrusion 28' engages with aperture 12'. In this way, the spring is self-aligning and does not require any precise location or matching parts during the manufacturing process.

With emphasis shifted to the cut-away, view of FIG. 8*b*, one may still better appreciate the construction of the embodiment first shown in FIGS. 7*a* through 8*b*. In particular, one of ordinary skill will still better observe that switch 11'" is preferably integrally formed and that protrusion 28' is preferably stamped to thereby form a hollow hemispherical member. It will, however, be appreciated that protrusion 28' may be formed into other shapes (for example, an elongated bar, or a cone) as long as aperture 12' is also changed to complement/accommodate such other shapes. During manufacturing, switch 11'" is preferably stamped from a beryllium-copper sheet that preferably has a thickness of between about 0.2 mm (0.0079 inches) and about 0.4 mm (0.0157 inches) (with about 0.3 mm—0.0118 inches—being most preferred) to ensure that intermediate member 25 can provide the desired biasing force and physical stability.

Figure 9B:
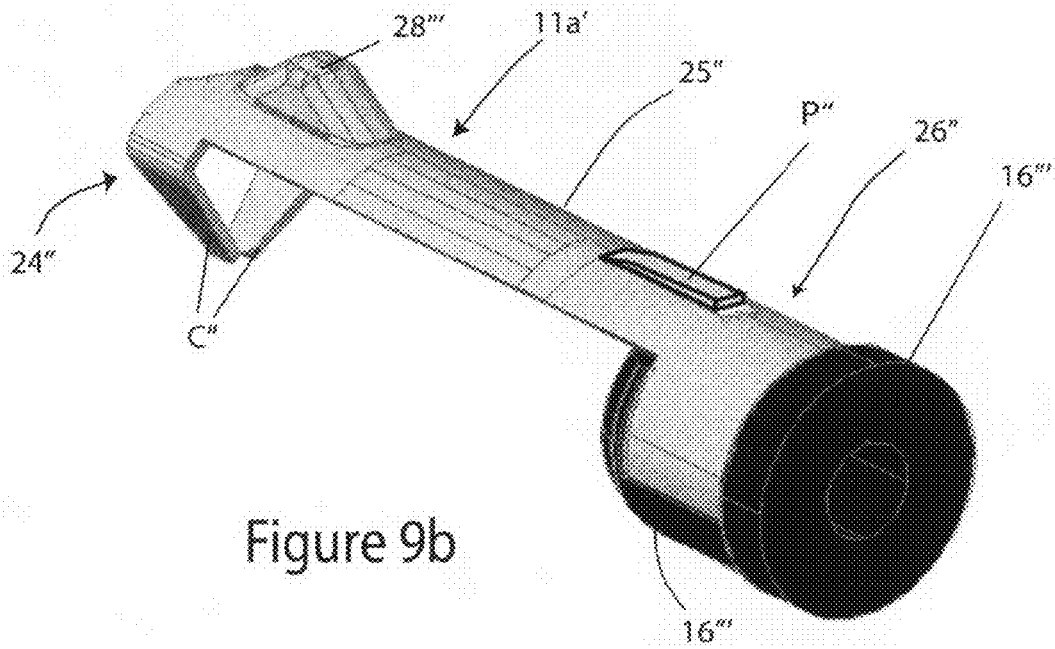
FIG. 9*b* shows a perspective view of a switch and an associated insulator for use with a self-muting audio connector in accordance with yet another embodiment of the invention.
Figure 9A:
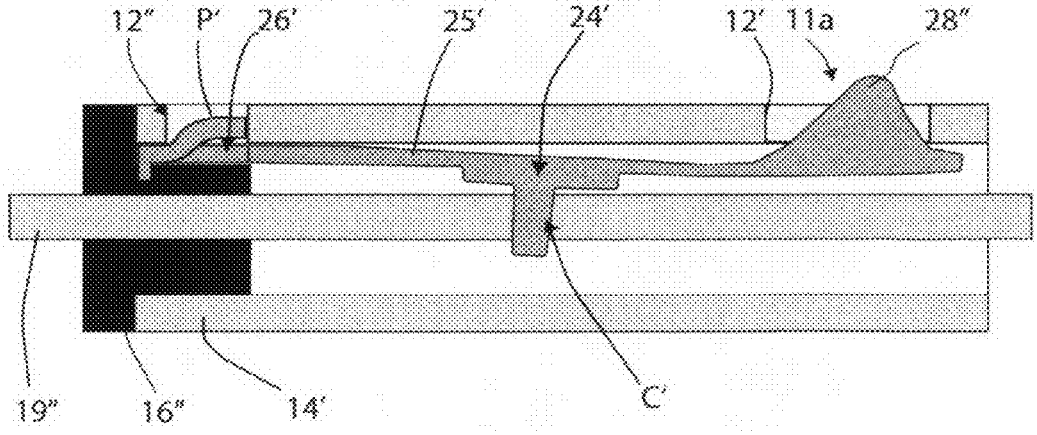
FIG. 9*a* shows a cross-sectional and partial view of another self-muting audio connector in accordance with the invention.

With reference to FIG. 9*a*, a self-muting audio connector in accordance with another preferred embodiment is shown and its operation illustrated therein. In particular, an inventive mono phone or "TS" (tip-sleeve) connector is shown with a cylindrical, tubular outer sleeve 14' of the type described above, the relevant conventional details of which also apply to this embodiment. The tip electrically is insulated from sleeve 14' by an annular insulator 16" and connected to a cylindrical inner rod 19" that is coaxial within the outer sleeve 14'. In its use to carry audio signals, TS connector is coupled to a coaxial shielded cable (not shown) by electrical communication with the cable ground conductor to ground terminal or lug and the central signal-carrying conductor of the cable to terminal.

This embodiment of the present invention provides a spring-biased grounding switch 11*a* disposed between the inner surface of tubular sleeve 14' and the outer surface of a signal conductor 19". When the connector is not inserted into an external jack, there is no force applied to protrusion 28" and the spring bias of the spring switch 11*a* causes the contact between grounding sleeve 14' and rod 19". Since conductive spring 11*a* is urged against the interior surface of sleeve 14', the tip is grounded through rod 19", switch 11*a* and sleeve 14'. In this way, whenever the phone connector is not in use (not inserted into a jack, such as jack 33 of FIG. 1) the tip is muted (grounded) and thus, there is no potential for generating a noise signal to be fed into the amplifier and broadcast through the speakers.

With continuing reference to FIG. 9*a*, grounding switch 11*a* comprises a conductive conductor-engaging member 24', a ground-sleeve engaging member 26' and a resilient (or spring biased) intermediate member 25'. The ground-sleeve engaging member 26' is in substantially continuous contact with the inner surface of outer sleeve 14' and the conductor-engaging member 24' is in selective contact with inner signal conductor 19". Nonetheless, switch 11*a* is preferably neither affixed to sleeve 14' nor affixed to rod 19" with any components or bonding materials. Rather, the spring-biasing force of member 25' preferably urges protrusion 28" through an aperture 12" and, in the state shown in FIG. 9*a*, urges itself against rod 19". Member 26' is preferably resilient and sized and shaped to snugly fit within the inside of sleeve 14' and it may, optionally, include one or more outward protrusions P' snugly received within a complementary aperture 12" to aid with such engagement and to thereby provide additional stability against rotational movement. Optionally, member 24' may include one or more contacts C' that enable more precise and reliable selective electrical coupling with signal conductor 19". It has been discovered that reliable operation of the inventive switch over long periods of time and many connector-insertion/removal cycles cannot be expected without some means of radically-reducing/substantially eliminating rotational motion of the switch 11*a* about the axis defined by member 19". Accordingly, some anti-rotation means (such as protrusion/aperture P'/12") is important for achieving switch reliability that approaches that expected of conventional TS connectors.

In operation the connector is inserted into a jack which includes a cylindrical receiving wall having an inner diameter just slightly larger than the outer diameter of sleeve 14' and a tip contact and securing member (such as member 36 of FIG. 1). Member 25' is resilient enough to permit protrusion 28" to move radially inward when the connector is inserted into an external jack. Such radially inward motion deforms member 25' sufficiently to thereby automatically break the electrical contact between member(s) 24' and rod 19". This creates a gap (not shown) between spring conductor-engaging member 24' and rod 19". When this occurs, a signal is no longer shorted to ground and may pass to the tip and vice versa. This allows a normal electrical connection to be established between the connector and the device to which the connector is inserted.

Spring switch 11*a* is advantageously/preferably stamped from a strip of conducting material, such as hardened spring steel, sized and shaped to bias itself (forming a physical and an electrical connection) against the inner wall of the cylindrical sleeve 14'. Member 24' may be described as being generally "horseshoe-shaped" and/or generally "c-shaped." The protrusion 28" is preferably integrally formed with the spring by stamping a smoothly rounded detent into the inside of spring 11*a*. Protrusion 28" is, therefore, also preferably formed of the same piece of spring as the rest of switch 11*a*. In an alternative construction, protrusion 28" may be formed from one of many well know durable materials, regardless of whether they are conductive or non-conductive, such as nylon, plastic, brass, steel or the like. With such an alternative construction, member 24' may include an aperture through which a portion of the protrusion may extend to enhance affixation.

The location of aperture 12" in the outer sleeve 14' determines the distance between the protrusion 28" and the tip. By adjusting that distance a given connector can be either a make-before-break connector or a break-before-make connector as described above. The present invention is capable of providing either with only a slight change in the location of the protrusion aperture 12". No other modification is required.

One particularly advantageous feature of the invention is that switch 11*a* is preferably not affixed either rod 19" or sleeve 14' by any conventional means such as a fastener or bonding material. This represents a significant advantage over the related art devices in that assembly of the inventive connector is greatly simplified, less expensive and involves fewer components. In particular, switch 11*a* is preferably inserted into sleeve 14' such that protrusion 28" is aligned with aperture 12' and such that protrusion P' is aligned with aperture 12"; then the unit is longitudinally slid into sleeve 14' until protrusion 28" extends through aperture 12' and until protrusion P' firmly snaps into aperture 12". In this way, the spring is a self-aligning, anti-rotation member and does not require any precise location or matching parts during the manufacturing process.

One of ordinary skill will still better observe that switch 11*a* is preferably integrally formed and that protrusions 28" and P' are preferably stamped. It will, however, be appreciated that protrusion 28" may be formed into various shapes (for example, an elongated bar, or a cone) as long as aperture 12" is also changed to complement/accommodate such other shapes. During manufacturing, switch 11*a* is preferably stamped from a beryllium-copper sheet that preferably has a thickness of between about 0.2 mm (0.0079 inches) and about 0.4 mm (0.0157 inches) (with about 0.3 mm—0.0118 inches—being most preferred) to ensure that intermediate member 25' can provide the desired biasing force and physical stability.

With reference to FIG. 9*b*, a switch for use with a self-muting audio connector in accordance with another preferred embodiment is shown. In particular, a switch is shown for an inventive mono phone or "TS" (tip-sleeve) connector of the type described above, the relevant details as shown in, for example FIG. 9*a*, also apply to this embodiment. The tip electrically is insulated from sleeve 14' by an annular insulator 16" and connected to a cylindrical inner rod 19" that is coaxial within the outer sleeve 14'. In its use to carry audio signals, TS connector is coupled to a coaxial shielded cable (not shown) by electrical communication with the cable ground conductor to ground terminal or lug and the central signal-carrying conductor of the cable to terminal.

This embodiment of the present invention provides a spring-biased grounding switch 11*a'* to be disposed between the inner surface of tubular sleeve 14' and the outer surface of a signal conductor 19". When the connector is not inserted into an external jack, there is no force applied to protrusion 28'" and the spring bias of the spring switch 11*a'* causes the contact between grounding sleeve 14' and rod 19". Since conductive spring 11*a'* is urged against the interior surface of sleeve 14', the tip is grounded through rod 19", switch 11*a'* and sleeve 14'. In this way, whenever the connector is not in use (not inserted into a jack, such as jack 33 of FIG. 1) the tip is muted (grounded) and thus, there is no potential for generating a noise signal to be fed into the amplifier and broadcast through the speakers.

With continuing reference to FIG. 9*b*, grounding switch 11*a*' comprises a conductive conductor-engaging member 24", a ground-sleeve engaging member 26" and a resilient (or spring biased) intermediate member 25". The ground-sleeve engaging member 26" is in substantially continuous contact with the inner surface of outer sleeve 14' and the conductor-engaging member 24" is in selective contact with inner signal conductor 19". Nonetheless, switch 11*a*' is preferably neither affixed to sleeve 14' nor affixed to rod 19" with any components or bonding materials. Rather, the spring-biasing force of member 25" preferably urges protrusion 28'" through a corresponding aperture and urges itself against rod 19". Member 26" is preferably resilient and sized and shaped to snugly fit within the inside of sleeve 14' and it may, optionally, include one or more outward protrusions P" snugly received within a complementary aperture to aid with such engagement and to thereby provide additional stability against rotational movement. Optionally, member 24" may include one or more contacts C" that enable more precise and reliable selective electrical coupling with signal conductor 19". It has been discovered that reliable operation of the inventive switch over long periods of time and many connector-insertion/removal cycles cannot be expected without some means of radically-reducing/substantially eliminating rotational motion of the switch 11*a*' about the axis defined by member 19". Accordingly, some anti-rotation means (such as a protrusion/aperture aperture arrangement) is important for achieving switch reliability that approaches that expected of conventional TS connectors.

In operation, the connector is inserted into a jack which includes a cylindrical receiving wall having an inner diameter just slightly larger than the outer diameter of sleeve 14' and a tip contact and securing member (such as member 36 of FIG. 1). Member 25" is resilient enough to permit protrusion 28'" to move radially inward when the connector is inserted into an external jack. Such radially inward motion deforms member 25" sufficiently to thereby automatically break the electrical contact between member(s) 24" and rod 19". This creates a gap (not shown) between spring conductor-engaging member 24" and rod 19". When this occurs, a signal is no longer shorted to ground and may pass to the tip and vice versa. This allows a normal electrical connection to be established between the connector and the device to which the connector is inserted.

Spring switch 11*a*' is advantageously/preferably stamped from a strip of conducting material, such as hardened spring steel, sized and shaped to bias itself (forming a physical and an electrical connection) against the inner wall of the cylindrical sleeve 14'. Member 24" may be described as being generally "horseshoe-shaped" and/or generally "c-shaped." The protrusion 28'" is preferably integrally formed with the spring by stamping a smoothly rounded detent into the inside of spring 11*a*'. Protrusion 28'" is, therefore, also preferably formed of the same piece of spring as the rest of switch 11*a*'. In an alternative construction, protrusion 28'" may be formed from one of many well know durable materials, regardless of whether they are conductive or non-conductive, such as nylon, plastic, brass, steel or the like. With such an alternative construction, member 24" may include an aperture through which a portion of the protrusion may extend to enhance affixation.

The location of aperture 12" in the outer sleeve 14' determines the distance between the protrusion 28'" and the tip. By adjusting that distance a given connector can be either a make-before-break connector or a break-before-make connector as described above. The present invention is capable of providing either with only a slight change in the location of the protrusion aperture 12". No other modification is required.

One particularly advantageous feature of the invention is that switch 11*a*' is preferably not affixed either rod 19" or sleeve 14' by any conventional means such as a fastener or bonding material. This represents a significant advantage over the related art devices in that assembly of the inventive connector is greatly simplified, less expensive and involves fewer components. In particular, switch 11*a*' is preferably inserted into sleeve 14' such that protrusion 28'" is aligned with aperture 12' and such that protrusion P" is aligned with aperture 12"; then the unit is longitudinally slid into sleeve 14' until protrusion 28'" extends through aperture 12' and until protrusion P" firmly snaps into aperture 12". In this way, the spring is a self-aligning, anti-rotation member and does not require any precise location or matching parts during the manufacturing process.

One of ordinary skill will still better observe that switch 11*a*' is preferably integrally formed and that protrusions 28'" and P" are preferably stamped. It will, however, be appreciated that protrusion 28'" may be formed into various shapes (for example, an elongated bar, or a cone) as long as aperture 12" is also changed to complement/accommodate such other shapes. During manufacturing, switch 11*a*' is preferably stamped from a beryllium-copper sheet that preferably has a thickness of between about 0.2 mm (0.0079 inches) and about 0.4 mm (0.0157 inches) (with about 0.3 mm—0.0118 inches—being most preferred) to ensure that intermediate member 25" can provide the desired biasing force and physical stability.

While the present invention has been described in connection with what is presently considered to be the most practical and preferred embodiments, it is to be understood that the invention is not limited to the disclosed embodiments, but is intended to encompass the various modifications and equivalent arrangements included within the spirit and scope of the appended claims. With respect to the above description, for example, it is to be realized that the optimum dimensional relationships for the parts of the invention, including variations in size, materials, shape, form, function and manner of operation, assembly and use, are deemed readily apparent to one skilled in the art, and all equivalent relationships to those illustrated in the drawings and described in the specification are intended to be encompassed by the appended claims. Therefore, the foregoing is considered to be an illustrative, not exhaustive, description of the principles of the present invention.

What is claimed is:

1. A self-muting audio connector for use with a complementary external jack, comprising: a conductive ground sleeve having an interior, an exterior and two ends configured to electrically couple the ground sleeve to at least two external circuits; at least one signal conductor at least partially disposed within said interior and comprising at least a pair of terminals, wherein (i) one terminal passes through one end of the sleeve for establishing a connection to at least one external circuit; and (ii) the other terminal passes through the other end of the sleeve for establishing a connection to at least one other external circuit; and an electrically conductive spring switch at least partially disposed within and electrically coupled to the interior of the ground sleeve, wherein the spring is configured to establish electrical contact with the at least one signal conductor in response to removal of the connector from the external jack, wherein the spring switch comprises a conductor-engaging member, a sleeve-engaging member and a resilient intermediate member, wherein the sleeve-engaging member is in substantially continuous contact with the sleeve and wherein the conductor-engaging member is in selective contact with the at least one signal conductor.

2. The electrical connector of claim 1 wherein the spring switch comprises a protrusion and a coil spring that is generally "e-shaped" in cross-section.

3. The electrical connector of claim 1 wherein the connector includes two signal conductors and the conductor-engaging member is in selective contact with both of the signal conductors.

4. The electrical connector of claim 1 wherein the spring switch is configured to break the electrical contact between the ground sleeve and the at least one signal conductor in response to insertion of the connector into the external jack.

5. The electrical connector of claim 1, wherein there are two signal conductors at least partially disposed within said interior, each of the signal conductors comprises at least a pair of terminals, wherein (i) at least one terminal passes through one end of the sleeve for establishing a connection to at least one of the two external circuits; and (ii) at least one other terminal passes through the other end of the sleeve for establishing a connection to at least one other of the two external circuits; and the spring switch consists essentially of one spring configured to establish electrical contact with both of the two signal conductors in response to removal of the connector from the external jack.

6. The electrical connector of claim 1, wherein the ground sleeve includes an aperture extending therethrough; the switch comprises a protrusion at least partially extending through the aperture and a spring that deforms to break contact with the at least one signal when the protrusion does not extend outwardly through the aperture of the sleeve.

7. The electrical connector of claim 1 wherein the spring switch comprises a conductor-engaging member, a sleeve-engaging member and a resilient intermediate member; the sleeve-engaging member is in substantially continuous contact with the sleeve and includes and anti-rotation protrusion; the conductor-engaging member is in selective contact with the signal conductor; conductor-engaging member and ground-sleeve engaging member are preferably elongated and aligned along parallel axes; and the intermediate member is angled relative to the parallel axes.

8. A self-muting audio connector, comprising: a conductive ground sleeve having an interior, an exterior and two ends configured to electrically couple the ground sleeve to at least two external circuits; at least one signal conductor at least partially disposed within said interior and comprising at least a pair of terminals, wherein (i) a terminal passes through one end of the sleeve for establishing a connection to at least one of the two external circuits; and (ii) another terminal that passes through the other end of the sleeve for establishing a connection to at least one other of the two external circuits; and means at least partially disposed within the interior of the ground sleeve for establishing electrical contact with the at least one signal conductor in response to removal of the connector from the external jack and for breaking electrical contact with the at least one signal conductor in response to insertion of the connector into the external jack, wherein the means for establishing and for breaking electrical contact comprise a conductor-engaging member, a sleeve-engaging member and a resilient intermediate member, wherein the sleeve-engaging member is in substantially continuous contact with the sleeve, and wherein the conductor-engaging member is in selective contact with the signal conductor, wherein the sleeve comprises an anti-rotation aperture and the ground-sleeve engaging member comprises an anti-rotation protrusion firmly received within the anti-rotation aperture.

9. The electrical connector of claim 8 wherein the spring switch comprises a conductive an integrally-formed protrusion and spring that is generally "e-shaped" in cross-section.

10. The electrical connector of claim 8 wherein means for establishing and breaking electrical contact consists essentially of a conductive and integrally-formed protrusion and a coil spring that is generally "e-shaped" in cross-section.

11. A spring switch for use in a self-muting audio connector of the type having a conductive ground sleeve with an interior and a first aperture, and at least one signal conductor at least partially disposed within the interior of the sleeve, the switch comprising a conductive spring configured be disposed within and make electrical contact with the interior of the sleeve and a first protrusion sized and shaped to at least partially extend through the first aperture of the sleeve, wherein the spring is in substantially continuous contact with the sleeve, and in selective contact with the signal conductor.

12. A spring switch of claim 11 wherein the spring switch further comprises an anti-rotation protrusion sized and shaped to be firmly received within an anti-rotation aperture of the sleeve.

13. A spring switch of claim 11 wherein the spring also makes electrical contact with the at least one signal connector when the first protrusion extends through the first aperture of the sleeve.

14. A spring switch of claim 11 wherein the spring deforms in response to the radially inward movement of the first protrusion such that it does not extends through the first aperture of the sleeve such that the spring does not make electrical contact with the at least one signal conductor.

15. The electrical connector of claim 11 wherein the spring switch comprises a conductor-engaging member, an anti-rotation and sleeve-engaging member and a resilient intermediate member; the anti-rotation member is in substantially continuous electrical contact with the sleeve; the conductor-engaging member is in selective electrical contact with the signal conductor; and the conductor-engaging member is located at the far end of the switch opposite the anti-rotation member.

16. The electrical connector of claim 11 wherein the spring switch comprises a conductor-engaging member, a sleeve-engaging member and a resilient intermediate member; the sleeve-engaging member is in substantially continuous contact with the sleeve; and the conductor-engaging member is in selective contact with the signal conductor.

17. The electrical connector of claim 11 wherein the spring switch comprises a generally "c-shaped" conductor-engaging member, a generally "c-shaped" sleeve-engaging member and an elongated and resilient intermediate member; the conductor-engaging and the sleeve-engaging members are respectively aligned along parallel axes; and the sleeve-engaging member comprises means for preventing rotation of the switch relative to the sleeve.

* * * * *